United States Patent [19]

Taylor et al.

[11] Patent Number: 4,628,825

[45] Date of Patent: Dec. 16, 1986

[54] SLIDING GATE ACTUATING MECHANISM

[75] Inventors: Fred J. Taylor, Covington; William I. Donnermeyer, Jr., Bellevue, both of Ky.

[73] Assignee: American Autogate Corporation, Cincinnati, Ohio

[21] Appl. No.: 395,917

[22] Filed: Jun. 27, 1984

[51] Int. Cl.[4] ..... B61D 7/20; B61D 7/28

[52] U.S. Cl. ..... 105/289; 105/253

[58] Field of Search ..... 298/24, 27; 105/239, 105/240, 241.1, 241.2, 247, 253, 248, 282 R, 288, 289, 290, 249

[56] References Cited

U.S. PATENT DOCUMENTS

| | | | |
|---|---|---|---|
| 3,255,714 | 6/1966 | Dorey | 105/253 |
| 3,348,501 | 10/1967 | Stevens et al. | 105/280 |
| 3,596,609 | 8/1971 | Ortner | 105/240 |
| 3,633,515 | 1/1972 | Shaver | 105/290 |
| 4,248,158 | 2/1981 | Chierici et al. | 105/282 R |

FOREIGN PATENT DOCUMENTS

| | | | |
|---|---|---|---|
| 1188761 | 9/1959 | France | 105/290 |
| 19446 | of 1903 | United Kingdom | 105/282 R |
| 21274 | of 1906 | United Kingdom | 105/282 R |

*Primary Examiner*—Robert B. Reeves
*Assistant Examiner*—Dennis C. Rodgers
*Attorney, Agent, or Firm*—Jerrold J. Litzinger

[57] ABSTRACT

An actuating mechanism for operating sliding gates of a railway hopper car which opens all the gates simultaneously, regardless of the direction which the gates must move to open. While moving in one direction, a shifting means coupled to each gate by means of pivoted levers moves some gates in one direction to the open position, while at least one gate moves to its open position in the opposing direction. The mechanism which shifts all the gates simultaneously is activated from one power source.

19 Claims, 8 Drawing Figures

SLIDING GATE ACTUATING MECHANISM

BACKGROUND OF THE INVENTION

1. Field of the Invention

The present invention relates generally to an apparatus for opening the sliding gates of a railway hopper car, and, in particular, to a novel apparatus for simultaneously opening all of the sliding gates of a railway hopper car, regardless of the direction in which the gate is moved.

2. Description of the Prior Art

A common type of railroad freight car in use today is the covered freight car of the type wherein the load is discharged through sliding doors, which are also known as sliding gates, on the underside of the body. Such cars are generally referred to as covered hopper cars and are used to haul grain, phosphate, plastic, and other dry bulk commodities that require protection from natural elements.

After covered hopper cars are spotted over an unloading pit, the sliding gates on the bottoms of the cars are presently opened and closed by either of two methods: Each gate can be manually cranked open or closed with a steel bar that is inserted into a fitting on the gate, one gate at a time; or, each gate can be opened and closed by manually applying a rotary drive air wrench to the same fitting on the gate, one gate at a time. While either of these methods will open the gates and allow the covered hopper to unload, both are time consuming because of the manual operation and because of the need to open each gate individually. Moreover, both methods are labor intensive and expose to injury those persons who are manually opening the sliding gates.

The problem of safely and efficiently unloading hopper cars has been addressed previously.

U.S. Pat. No. 3,633,515, issued to Shaver et al., describes a power operated door opening and closing mechanism for rotating doors; U.S. Pat. No. 3,596,609, issued to Ortner et al., describes a system for simultaneously opening rotating hopper doors. U.S. Pat. No. 3,348,501, issued to Stevens et al., describes a sliding gate system, individually activated, for discharging the hopper contents through either one large opening or two smaller side-by-side openings; French Pat. No. 1,188,761 describes a sliding gate system which automatically opens all the sliding gates of a railway car in one direction.

However, none of the above systems address the problem of opening the sliding gates on a hopper car when some of the gates must be moved in opposite directions. This problem occurs in a significant number of railway hopper cars having two, three, or four sliding gates. To avoid interference with the railcar's trucks, the gates are positioned such that at least one of the sliding gates moves in an opposing direction to the movement of the other gates.

SUMMARY OF THE INVENTION

It is an object of the present invention to provide a mechanism for a hopper car having sliding gates that will simultaneously open all of the gates, regardless of the direction the gates must move to open.

It is a further object of this invention to provide a system for opening all of the sliding gates of a hopper car simultaneously from one power source such that the car can be unloaded quickly and safely.

It is still a further object of this invention to provide a mechanism for simultaneous opening of all sliding gates of a hopper car that can be easily retrofitted to existing hopper railway cars as well as to be incorporated into new construction.

These and other objects may be accomplished by use of a shifting mechanism mounted on the underside of the hopper which is coupled to each of the sliding gates which opens all gates simultaneously, regardless of direction for opening, when activated by a single power source. Levers connecting each sliding door to the shifting mechanism pivot in the proper manner to enable each door to open as the shifting mechanism is moved in one direction.

DESCRIPTION OF THE PREFERRED EMBODIMENT

Figure 1:
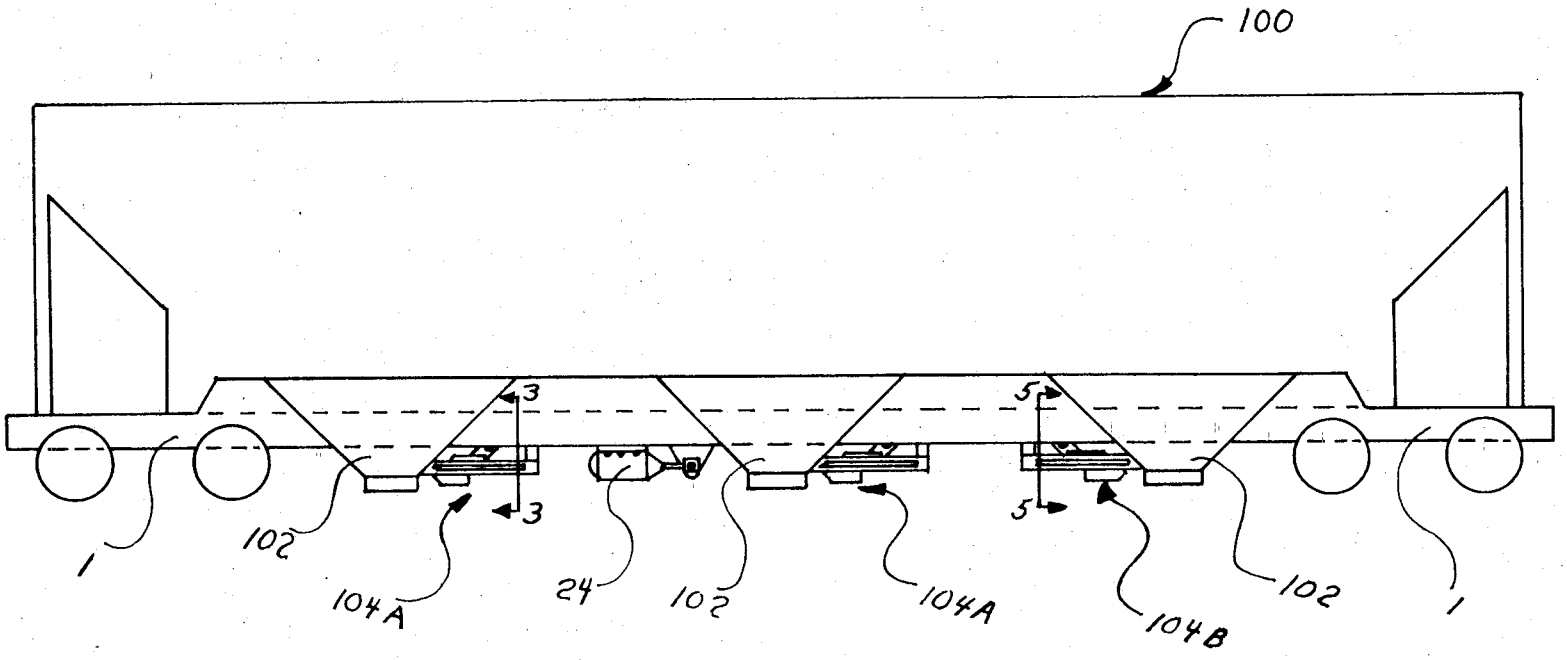
FIG. 1 is an elevational view of the present invention installed on a standard three pocket hopper car.

Referring now to FIG. 1, there is shown a typical railway hopper car, generally designated at 100, equipped with a preferred embodiment of the present invention. Car 100 is provided with a plurality of hopper units 102 and a longitudinally extending center frame member or sill 1. An air cylinder 24 is mounted to car 100 on the underside of sill 1 to provide power for the mechanism of the present invention. The operation of air cylinder 24 is well known in the art, and it is within the scope of the present invention to use any suitable power source (electric, liquid, steam) to operate cylinder 24.

The sliding door actuating mechanisms of the present invention are generally indicated at **104*a* and 104*b*. Mechanism 104*a* is devised to open hopper units 102 by shifting the sliding gate to the right as shown in FIG. 1, while mechanism 104*b* operates by shifting the sliding gate to the left. Detailed operation of mechanisms 104*a* and 104*b*** will be described hereinafter.

Figure 2:
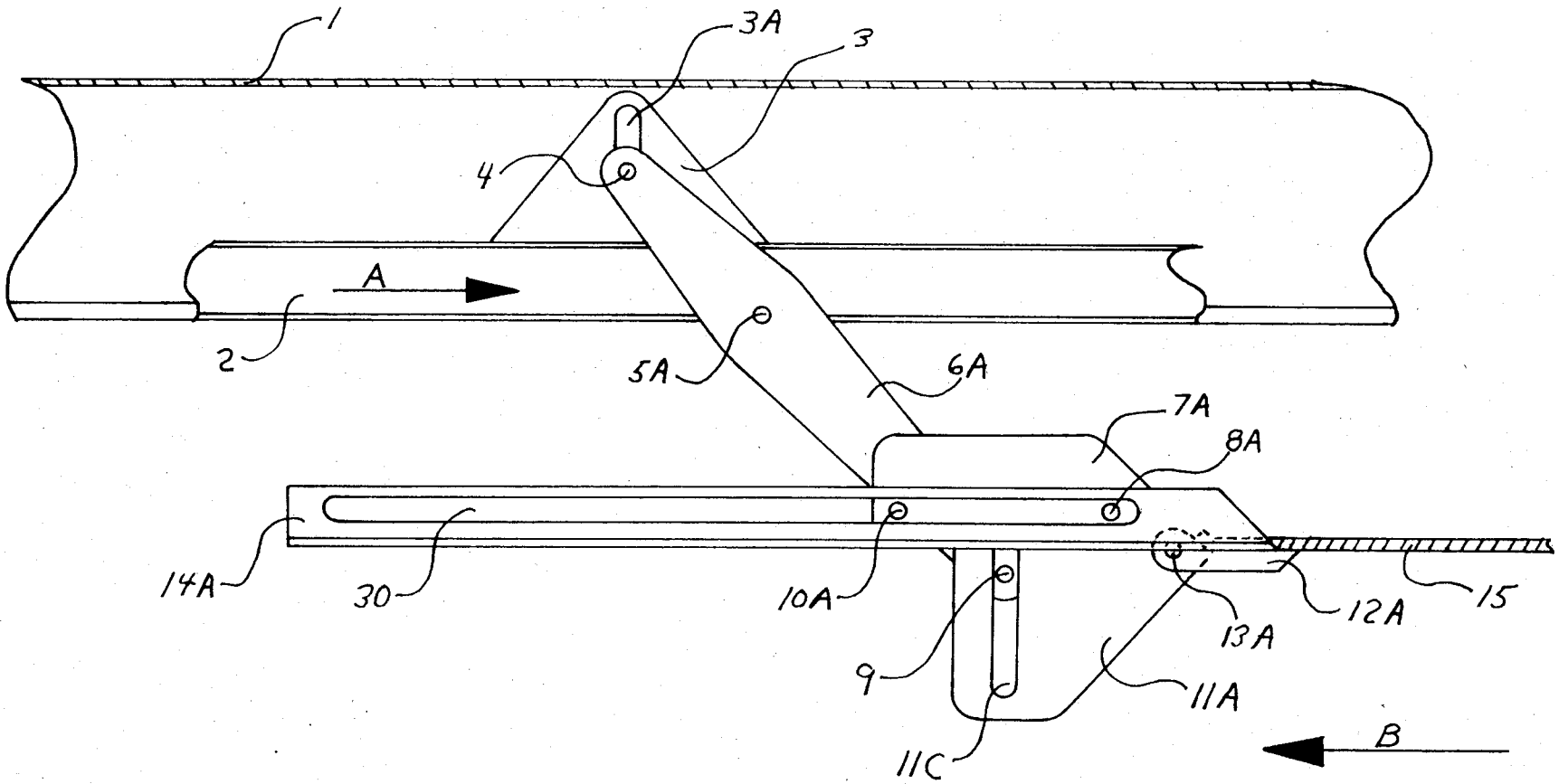
FIG. 2 is an elevational view, partly in cross section, illustrating the reversing gate actuating mechanism of the present invention.
Figure 3:
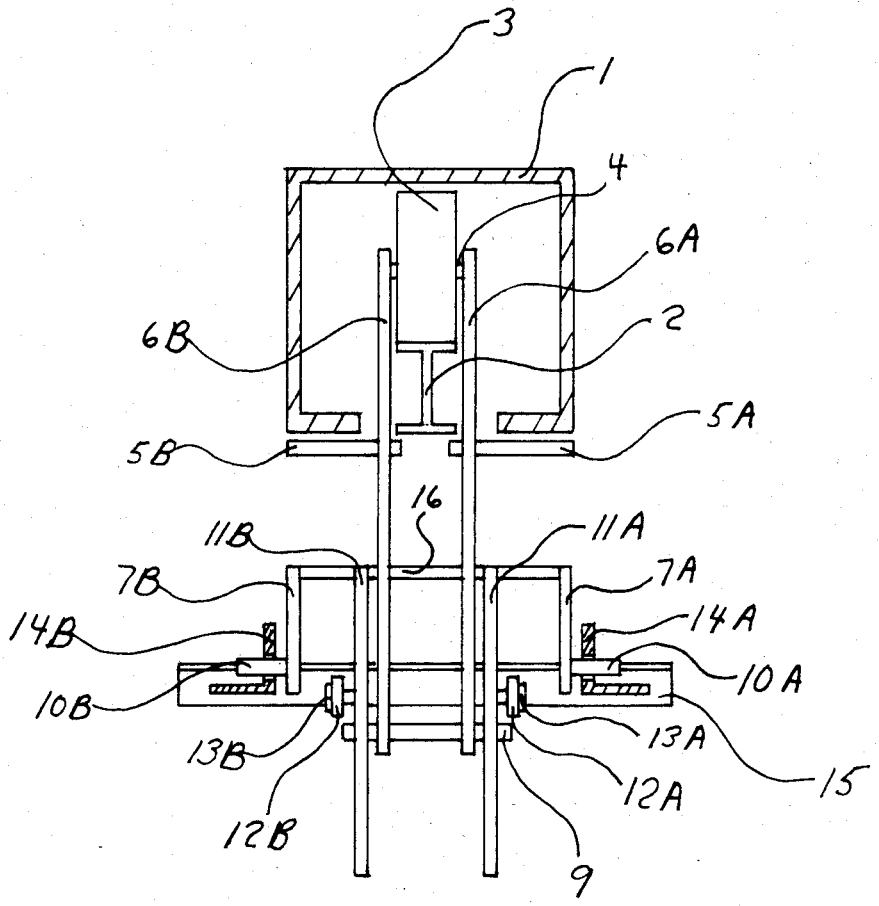
FIG. 3 is a cross-sectional view taken along lines 3—3 of FIG. 1.

Mechanism **104*b* is most clearly shown in FIGS. 2 and 3. Sill 1 of the car is of inverted U-shaped cross section with inwardly depending legs. A pair of vertical drive levers 6*a* and 6*b* are pivotally affixed to sill 1 by a pair of mounting pins 5*a* and 5*b* through the central portion of the levers. The upper portion of drive levers 6*a* and 6*b* are linked together by a guide pin 4 which is slidably enclosed within a vertical slot 3*a* of an upwardly depending extension member 3 of an actuating beam 2. The lower portion of levers 6*a* and 6*b* are linked together by a drive pin 9. Drive pin 9 is constructed such that it extends beyond the sides of levers 6a and 6b. One end of drive pin 9 is slidably received within a vertical slot 11c of a drive guide member 11a while the other end of pin 9 is slidably received in a vertical slot 11d (not shown) of a drive guide member 11b. Drive guide members 11a and 11b are substantially identical, and are rigidly affixed to each other by a support plate 16**.

A sliding gate 15 is affixed to drive guide members 11a and 11b by a pair of connector links 12a and 12b. Connector links 12a and 12b are rigidly affixed to gate 15, and are coupled to drive guide members 11a and 11b via a pair of connector pins 13a and 13b, respectively. In addition, a pair of tracking guides 14a and 14b are rigidly affixed to gate 15.

A pair of tracking frame members 7a and 7b are also rigidly affixed to drive members 11a and 11b by support plate 16. Tracking frame members 7a and 7b each contain a pair of tracking pins 8a, 10a and 8b, 10b respectively. The pair of tracking pins 8 and 10 are spaced apart on tracking frame member 7 so as to lie in a plane which is parallel to sill 1. The tracking pins are so constructed as to be slidably contained within a horizontal groove 30 in tracking guides 14a and 14b.

Figure 4:
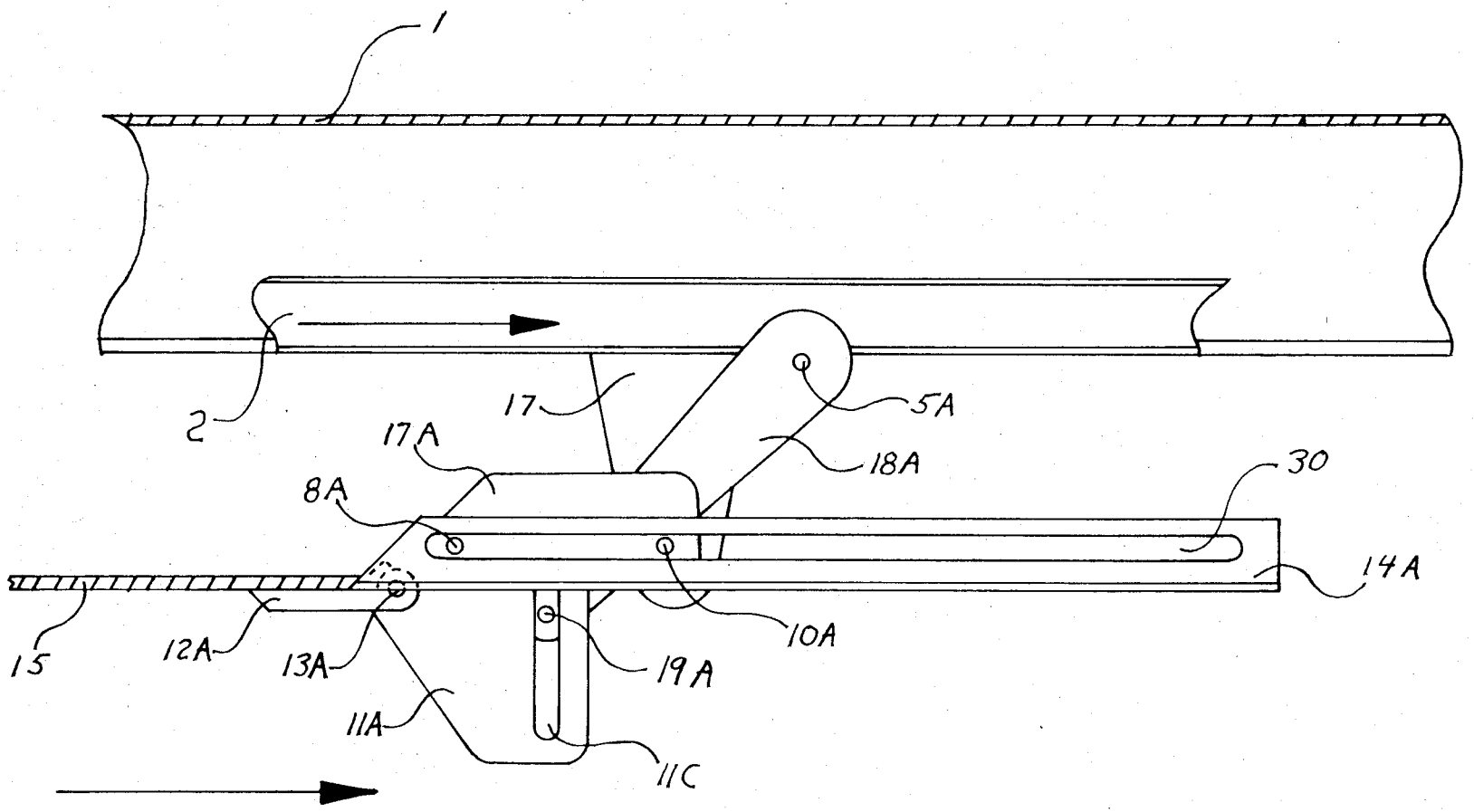
FIG. 4 is an elevational view, partly in cross section, illustrating the non-reversing gate mechanism of the present invention.
Figure 5:
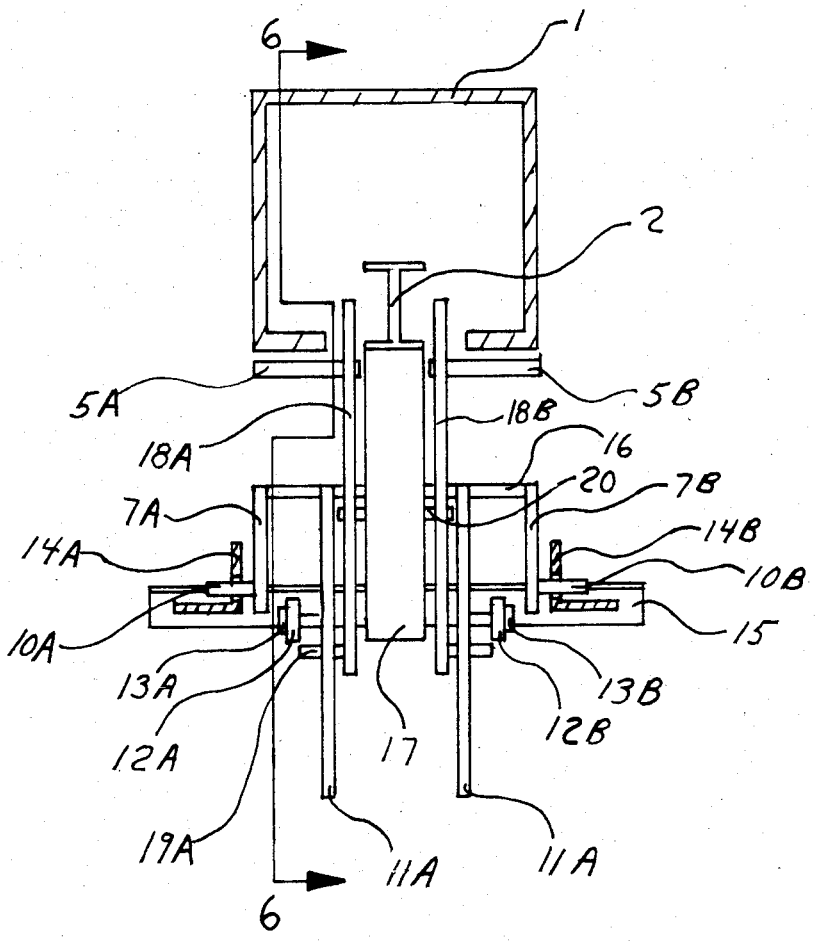
FIG. 5 is a cross-sectional view taken along lines 5—5 of FIG. 1.
Figure 6:
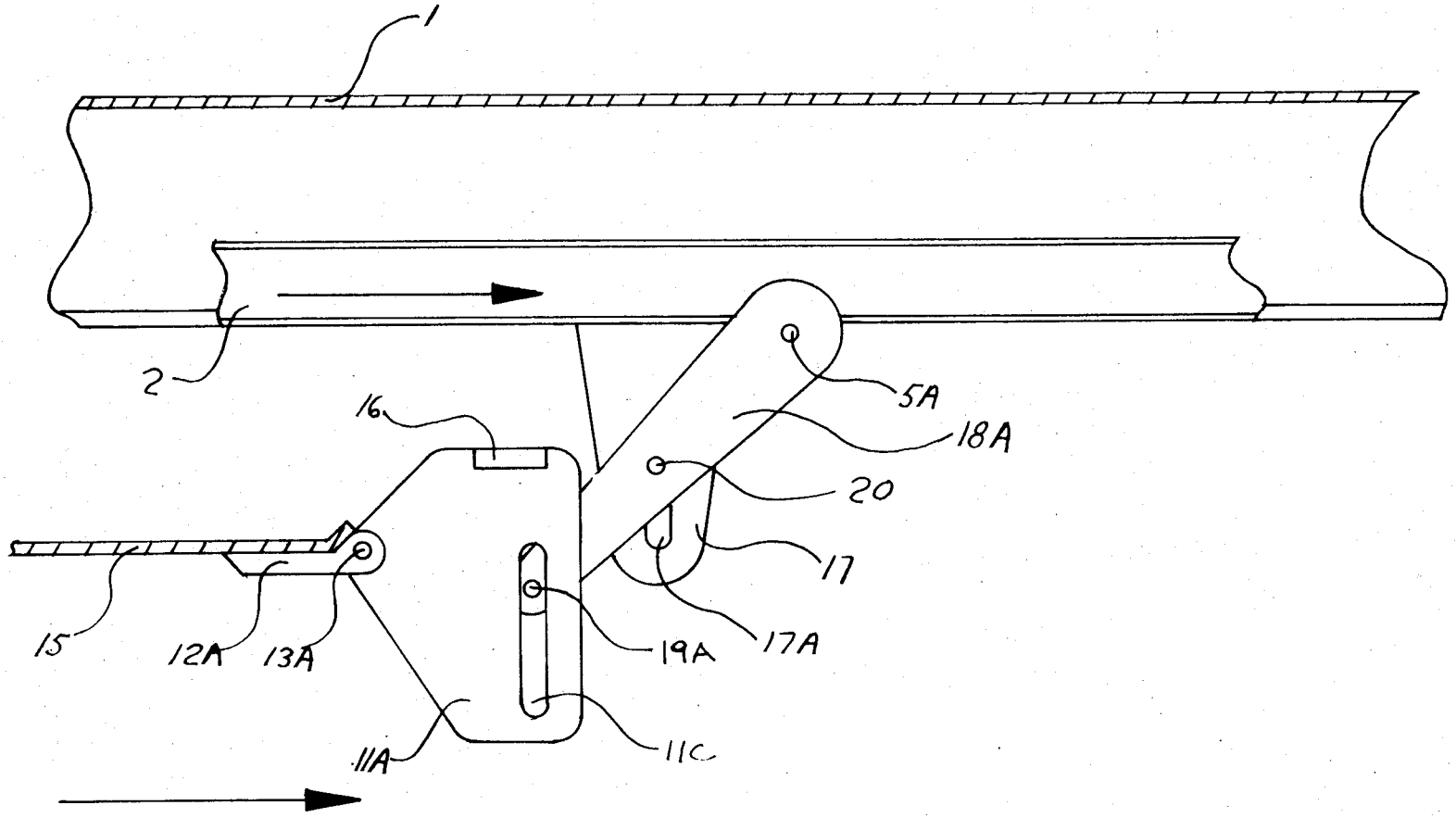
FIG. 6 is a fragmentary cross-sectional view taken along lines 6—6 of FIG. 5.

Mechanism 104a is most clearly shown in FIGS. 4, 5, and 6. A pair of vertical drive levers 18a and 18b are pivotally affixed at their upper portions to sill 1 by a second pair of mounting pins 5a and 5b. The central portions of levers 18a and 18b are linked together by a guide pin 20. Pin 20 is slidably enclosed within a slot 17a of a downwardly depending extension member 17 of actuating beam 2 which extends between levers 18a and 18b. The lower portions of levers 18a and 18b each contain a drive pin 19a and 19b respectively, which pins extend outwardly from the levers. Pins 19a and 19b are slidably received in vertical slots 11c, 11d contained in a second pair of drive guide members 11a and 11b, which members are substantially identical and are rigidly affixed to each other by a second support plate 16.

Figures 7, 8:
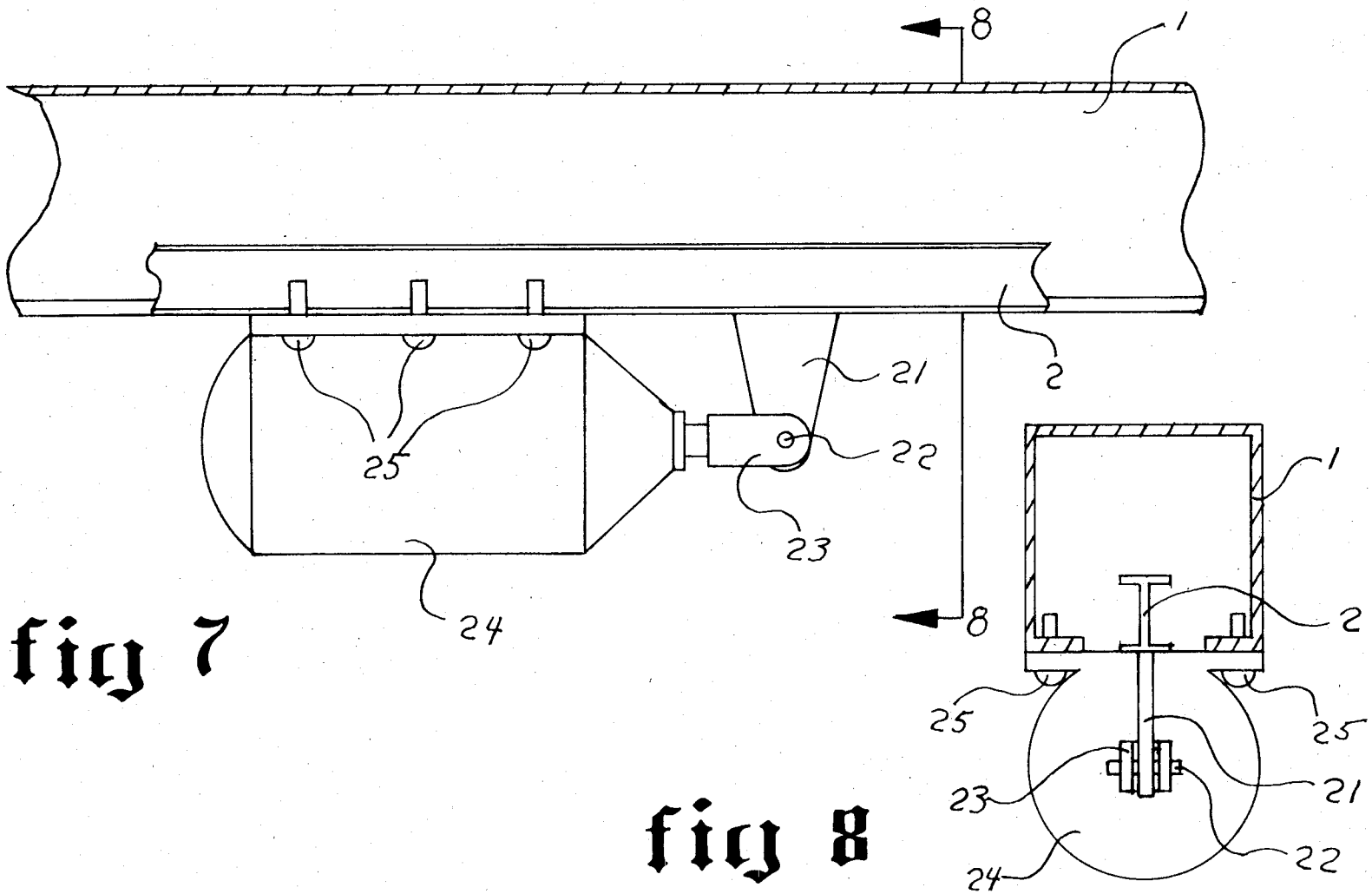
FIG. 7 is an elevational view, partly in cross-section, illustrating the activating means of the present invention.
FIG. 8 is a cross-sectional view taken along lines 8—8 of FIG. 7.

Referring now to FIGS. 7 and 8, air cylinder 24 and its operation will be described. Cylinder 24 is rigidly affixed to the underside of sill 1 by a series of rivets 25. A clevis 23 is attached to the operating rod of cylinder 24, which clevis is coupled to a downwardly depending extension member 21 of actuating beam 2 via a pin 22. In operation, when air is applied to cylinder 24, its operating rod forces clevis 23, and consequently actuating beam 2 in the direction indicated by arrow A.

The operation of the door-actuating mechanism may be described as follows. With respect to mechanism 104a, as actuating beam 2 is moving in the direction of arrow A, the following reaction is occurring: vertical drive levers 18a and 18b begin to swing in a counterclockwise direction, due to beam extension member 7 pushing against guide pin 20. This causes drive pins 19a and 19b to push against drive guides 11a and 11b, moving them and, consequently, gate 15 in the direction of arrow A. The mechanism is assured of moving in a straight line, parallel to sill 1, by the action of tracking pins 8 and 10 sliding within groove 30 of the tracking guide, eliminating any possibility of lifting of the sliding gates as they open.

With respect to mechanism 104b, as actuating beam 2 moves in the direction of arrow A (FIG. 2), beam extension member 3 pushes against guide pin 4, causing vertical levers 6a and 6b to rotate in a clockwise direction. This causes drive pin 9 to move in a clockwise arc, pushing drive guides 11a and 11b, and consequently gate 15, in the direction of arrow B in FIG. 2, thus opening the gate.

The slots in the actuating beam extension members 3 and 17 permit guide pins 4 and 20 to travel up or down in a vertical plane as beam 2 moves horizontally, eliminating any lifting of beam 2, which in turn assures that there is no lifting of the gates and thus no binding. Vertical slots 11c and 11d permit drive pins 9, 19a, and 19b to travel up or down in a vertical plane as drive levers 6a, 6b, 18a, and 18b travel in an arcuate path.

While the invention has been shown and described in terms of a preferred embodiment thereof, it will be understood that this invention is not limited to this particular embodiment and that many changes and modifications may be made without departing from the true spirit and scope of the invention as defined in the appended claims.

Having thus described our invention in certain exemplary embodiments, and with the understanding that modifications may be made therein without departing from the spirit and purpose, what we desire to secure and protect by Letters Patent is:

1. A hopper car, comprising:

a body;

a plurality of discharge chutes along the underside of said body;

a plurality of sliding gates for closing said discharge chutes;

means for shifting each of said sliding gates between a first position fully closing said discharge chutes and a second position fully opening said discharge chutes, wherein at least one of said sliding gates travels in the opposite direction from the other sliding gates when moving from said first to said second position;

a plurality of drive levers coupling said shifting means to said sliding gates;

and a single activating means, operative in a linear direction, for simultaneously shifting all of said sliding gates from said first to said second position.

2. The car of claim 1, further comprising a center frame member extending longitudinally along said underside of said body for supporting said shifting means.

3. The car of claim 2, wherein said activating means comprises an air cylinder rigidly affixed to said center frame member, which cylinder is coupled to said shifting means.

4. The car of claim 2, wherein said plurality of drive levers include at least one of a set of first drive levers each having a guide pin through one end thereof, a drive pin through its opposite end, and being pivotally affixed at its central region to said center frame member; and at least one of a set of second drive levers, each pivotally affixed at one end to said center frame member, having a drive pin through the other end, and a guide pin through the central region thereof.

5. The car of claim 4, wherein said shifting means comprises:

a first set of actuating members extending perpendicularly above said shifting means, with each of said first actuating members containing a vertical slot therein; and a second set of actuating members extending perpendicularly below said shifting means, with each of said second actuating members containing a vertical slot therein.

6. The car of claim 5, wherein each of said sliding gates includes a drive guide member affixed thereto, each of which contains a vertical slot therein.

7. The car of claim 6, wherein the guide pin of each of said first drive levers is slidably affixed within the vertical slot of one said first set of actuating members, and the drive pin of the same drive lever is slidably affixed within the vertical slot of a drive guide member of a sliding gate such that when said shifting means is enabled by said activating means said guide pins and said drive pins slide within their respective vertical slots as each of said first drive levers rotate about its pivot affixed to said center frame member.

8. The car of claim 7, wherein the guide pin of each of said second drive levers is slidably affixed within the vertical slot of one of said second set of actuating members, and the drive pin of the same drive lever is slidably affixed within the vertical slot of a drive guide member of a sliding gate, such that when said shifting means is enabled by said activating means, said guide pins and said drive pins slide within their respective vertical slots as each of said second drive levers move in an arcuate path about its pivot.

9. The car of claim 8, wherein the movement of said sliding gates affixed to said first set of actuating members of said shifting means is in the opposite direction of said sliding gates affixed to said second set of actuating members.

10. The car of claim 9, wherein said sliding gates include horizontal guide means for ensuring that said sliding gates travel in a substantially horizontal plane.

11. The car of claim 10, wherein said horizontal guide means comprises: a tracking frame, rigidly affixed to each drive guide, containing a horizontal slot; a pair of tracking pins, coupled to said tracking frame, which are spaced apart in the same horizontal plane; and a tracking guide affixed to said sliding gate, containing a horizontal slot, wherein said tracking pins move within said slot in said tracking guide as said sliding gate moves between said open and said closed positions.

12. The car of claim 9, wherein each actuating member has a pair of drive levers affixed thereto, with said actuating member positioned between said drive lever pair.

13. The car of claim 12, wherein each sliding gate has a pair of drive guide members affixed thereto, with its corresponding drive levers positioned therebetween.

14. A mechanism for actuating sliding gates of a hopper car of the type having a body, a pluraity of discharge chutes along the underside of the body, and a plurality of sliding gates for closing the dischrge chutes, said mechanism comprising:

means for shifting each of said sliding gates between a first closed position and a second open position, wherein at least one of said sliding gates travels in the opposite direction from the other sliding gates when moving from said first to said second position; a plurality of drive levers coupling each of said sliding gates to said shifting means; and a sole activating means, located on said underside of said body and operative along a line parallel to the longitudinal axis of said car, for simultaneously shifting all of said sliding gates from said first to said second position.

15. The mechanism of claim 14, further comprising a center frame member extending longitudinally along the underside of said body for supporting said shifting means and said activating means.

16. The mechanism of claim 15, wherein said plurality of drive levers includes at least one of a set of first drive levers each having a guide pin through one end thereof, a drive pin through its opposite end, and being pivotally affixed at its central region to said center frame member; and at least one of a set of second drive levers, each pivotally affixed at one end to said center frame member, having a drive pin through the other end, and a guide pin through the central region thereof.

17. The mechanism of claim 16, wherein said shifting means comprises:

a first set of actuating members extending perpendicularly above said shifting means, with each of said first actuating members containing a vertical slot therein; and a second set of actuating members extending perpendicularly below said shifting means, with each of said second actuating members containing a vertical slot therein.

18. A mechanism for actuating sliding gates of a hopper car of a type having a body, a center frame member, extending longitudinally along the underside of said body, a plurality of discharge chutes along the underside of the body, and a plurality of sliding gates for closing the discharge chutes, said mechanism comprising:

means for shifting each of said sliding gates between an open and a closed position, wherein at least one of said sliding gates travels in the opposite direction from the other sliding gates when moving from the closed to the open position; a plurality of levers for coupling each of said sliding gates to said shifting means; and a single activating means, affixed to said center frame member, containing means capable of linear movement in a direction parallel to the longitudinal axis of said car, for simultaneously shifting all of said sliding gates from said closed to said open position.

19. The mechanism of claim 18, wherein said linear motion means comprises a clevis directly coupled to said shifting means.

* * * * *